US011749443B2

(12) United States Patent
Annen

(10) Patent No.: US 11,749,443 B2
(45) Date of Patent: Sep. 5, 2023

(54) COIL COMPONENT AND MANUFACTURING METHOD FOR THE SAME

(71) Applicant: Murata Manufacturing Co., Ltd., Kyoto-fu (JP)

(72) Inventor: Kazunori Annen, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 842 days.

(21) Appl. No.: 16/519,580

(22) Filed: Jul. 23, 2019

(65) Prior Publication Data

US 2020/0043645 A1 Feb. 6, 2020

(30) Foreign Application Priority Data

Aug. 1, 2018 (JP) ..... 2018-144834

(51) Int. Cl.

| | |
|---|---|
| ***H01F 5/00*** | (2006.01) |
| ***H01F 27/28*** | (2006.01) |
| ***H01F 27/32*** | (2006.01) |
| ***H01F 41/12*** | (2006.01) |
| ***H01F 41/04*** | (2006.01) |

(52) U.S. Cl.
CPC ..... *H01F 27/2804* (2013.01); *H01F 27/323* (2013.01); *H01F 41/041* (2013.01); *H01F 41/122* (2013.01); *H01F 2027/2809* (2013.01)

(58) Field of Classification Search
CPC ..... H01F 27/2804; H01F 27/323
USPC ..... 336/200
See application file for complete search history.

(56) References Cited

U.S. PATENT DOCUMENTS

2005/0269698 A1 12/2005 Okada et al.
2007/0247268 A1 10/2007 Oya et al.
2008/0150663 A1* 6/2008 Yeh ..... H01F 17/0006 336/83
2008/0180204 A1* 7/2008 Noire ..... H01L 23/5227 336/173
2010/0013345 A1* 1/2010 Yarger ..... H01F 27/366 310/216.003
2010/0108233 A1* 5/2010 Sato ..... H01F 17/0013 156/60
2010/0301966 A1* 12/2010 Yoshino ..... H03H 7/09 336/200

(Continued)

FOREIGN PATENT DOCUMENTS

CN 1705124 A 12/2005
CN 102164464 A 8/2011

(Continued)

OTHER PUBLICATIONS

English translation of JP2005050956 (Year: 2005).*

(Continued)

*Primary Examiner* — Ronald Hinson
(74) *Attorney, Agent, or Firm* — Studebaker & Brackett PC

(57) ABSTRACT

A coil component includes a multilayer body in which a plurality of resin insulation layers is laminated, a spiral-shaped coil conductor layer disposed on main surface of one of the resin insulation layers, and a close contact layer disposed at interfaces between two of the resin insulation layers and not connected to the coil conductor layer. The close contact layer contains a metal having desired adhesion to the resin insulation layers.

12 Claims, 13 Drawing Sheets

(56) References Cited

U.S. PATENT DOCUMENTS

| | | | | |
|---|---|---|---|---|
| 2011/0200788 | A1 | 8/2011 | Maeda et al. | |
| 2014/0232501 | A1* | 8/2014 | Kato | H01F 17/0013 336/182 |
| 2015/0061810 | A1* | 3/2015 | Lim | H01F 27/292 156/89.12 |
| 2016/0111195 | A1 | 4/2016 | Nishyama | |

FOREIGN PATENT DOCUMENTS

| | | | |
|---|---|---|---|
| JP | 2000-150238 | A | 5/2000 |
| JP | 2007-103475 | A | 4/2007 |
| JP | 2007-250924 | A | 9/2007 |
| JP | 2014-127718 | A | 7/2014 |
| JP | 2016-082016 | A | 5/2016 |

OTHER PUBLICATIONS

An Office Action mailed by China National Intellectual Property Administration dated Jan. 5, 2022 which corresponds to Chinese Patent Application No. 201910628707.X and is related to U.S. Appl. No. 16/519,580 with English language translation.

An Office Action; "Notice of Reasons for Refusal," mailed by the Japanese Patent Office dated Feb. 16, 2021, which corresponds to Japanese Patent Application No. 2018-144834 and is related to U.S. Appl. No. 16/519,580 with English language translation.

* cited by examiner

COIL COMPONENT AND MANUFACTURING METHOD FOR THE SAME

CROSS-REFERENCE TO RELATED APPLICATION

This application claims benefit of priority to Japanese Patent Application No. 2018-144834, filed Aug. 1, 2018, the entire content of which is incorporated herein by reference.

BACKGROUND

Technical Field

The present disclosure relates to a coil component and a manufacturing method for the same.

Background Art

Electronic components have been mounted on various electronic apparatuses. As one of the electronic components, for example, a multilayer coil component is known as described, for example, Japanese Unexamined Patent Application Publication No. 2014-127718. A multilayer inductor component includes a base body on which a plurality of insulation layers is laminated, and a coil conductor layer wound on a main surface of the insulation layer.

SUMMARY

It is noted that, in the above-mentioned inductor component, adhesion strength between the laminated insulation layers may decrease due to a residue of the resist or the like used in a manufacturing process of the inductor component. The decrease in the adhesion force may cause interfacial peeling due to a thermal load during the manufacturing process, after the mounting, or the like. The interfacial peeling may raise a risk that the moisture entering from the exterior decreases a value of insulation resistance between the coil conductor layers or inside the coil conductor layers so that the deterioration in electric characteristics, an operation failure, or the like is caused by a short circuit, an open circuit, or the like.

The present disclosure provides a multilayer body which suppresses interfacial peeling between laminated resin insulation layers.

A coil component according to an aspect of the present disclosure includes a multilayer body in which a plurality of resin insulation layers is laminated, a coil conductor layer formed in a spiral shape and disposed on a main surface of one of the resin insulation layers, and a close contact layer disposed at an interface between two of the resin insulation layers and not connected to the coil conductor layer. The close contact layer contains a metal having desired adhesion to the resin insulation layer.

According to this configuration, it is possible to suppress a decrease in adhesion strength of the interface between the plurality of laminated resin insulation layers, and to suppress interfacial peeling due to a thermal load during the manufacturing process, after the mounting, or the like.

In the coil component described above, it is preferable that the close contact layer be disposed on the main surface of the resin insulation layer. According to this configuration, it is possible to suppress the decrease in the adhesion strength at the interface between the resin insulation layers, and suppress the interfacial peeling more effectively, at the interface between the resin insulation layers in which the adhesion strength is likely to decrease due to the arrangement of the coil conductor layer.

In the coil component described above, it is preferable that the close contact layer include one plane in a central region of the spiral-shaped coil conductor layer. According to this configuration, it is possible to suppress the decrease in the adhesion strength between the resin insulation layers in the central region of the spiral-shaped coil conductor layer.

In the coil component described above, it is preferable that the close contact layer include a plurality of small pieces being spaced from each other in the central region of the spiral-shaped coil conductor layer. According to this configuration, it is possible to suppress the decrease in the adhesion strength between the resin insulation layers in the central region of the spiral-shaped coil conductor layer.

In the coil component described above, it is preferable that the close contact layer be formed continuously along the coil conductor layer. According to this configuration, it is possible to suppress the decrease in the adhesion strength between the resin insulation layers in an area between winding sections of the coil conductor layer.

In the coil component described above, it is preferable that a plurality of close contact layers be disposed being spaced from each other along the coil conductor layer. According to this configuration, it is possible to suppress the decrease in the adhesion strength between the resin insulation layers in the area between the winding sections of the coil conductor layer.

In the coil component described above, it is preferable that the multilayer body have a through-hole passing through the multilayer body in a lamination direction of the plurality of resin insulation layers in the central region of the spiral-shaped coil conductor layer, and include an internal magnetic path filling the through-hole. According to this configuration, magnetic flux generated by the coil flows through the internal magnetic path, thereby making it possible to improve the inductance.

In the coil component described above, it is preferable that the coil conductor layer and the close contact layer be made of different materials from each other. According to this configuration, it is possible to select an optimum material for each of the coil conductor layer and the close contact layer.

In the coil component described above, it is preferable that the coil conductor layer be formed of a seed layer containing chromium or titanium, and a wiring layer containing copper disposed on the seed layer, and that the close contact layer be made of chromium or titanium. According to this configuration, it is possible to easily suppress the decrease in the adhesion strength of the resin insulation layer without requiring a process of forming irregularities to obtain an anchor effect.

In the coil component described above, it is preferable that a thickness of the coil conductor layer be about 1 μm to about 100 μm, and a thickness of the close contact layer be equal to or less than about 0.1 μm. According to this configuration, it is possible to reduce influence of the close contact layer on the flatness of the resin insulation layer.

In the above-described coil component, the coil component is further provided with a first magnetic substrate and a second magnetic substrate including the multilayer body, and in the multilayer body, the resin insulation layers are laminated in a direction from the first magnetic substrate toward the second magnetic substrate.

Due to a difference between a thermal expansion coefficient of the first and second magnetic substrates and a thermal expansion coefficient of the plurality of resin insulation layers constituting the multilayer body, the adhesion strength is likely to decrease. As such, the close contact layer is provided to suppress the decrease in the adhesion strength, whereby an effect of suppression of the interfacial peeling is more effectively exhibited.

A manufacturing method for a coil component according to an aspect of the present disclosure is a manufacturing method for a coil component including a multilayer body in which a plurality of resin insulation layers is laminated and a coil conductor layer formed in a spiral shape and disposed on one main surface of the resin insulation layer. The manufacturing method is also a manufacturing method for a coil component including a plurality of resin insulation layers, and a multilayer body in which a coil conductor layer formed in a spiral shape and a close contact layer are formed on one main surface of the resin insulation layer. Each of the methods includes forming a seed layer on an upper surface of a first resin insulation layer; forming a resist layer on an upper surface of the seed layer; forming a cavity in the resist layer; forming a wiring layer on the upper surface of the seed layer inside the cavity; removing the resist layer; forming a coil conductor layer of a spiral shape including the wiring layer and the seed layer covered with the wiring layer by partially etching the seed layer, and causing the seed layer spaced from the seed layer forming the coil conductor layer to become a close contact layer; and forming a second resin insulation layer covering the upper surface of the first resin insulation layer, the coil conductor layer, and the close contact layer.

According to this configuration, it is possible to easily form the coil component capable of suppressing the decrease in adhesion strength between the plurality of laminated resin insulation layers.

In the above-described manufacturing method for the coil component, it is preferable that the forming of the seed layer include forming, on the upper surface of the first resin insulation layer, a first seed layer made of a metal having desired adhesion to the first and second resin insulation layers, and forming a second seed layer made of a material different from a material of the first seed layer, on an upper surface of the first seed layer.

In the above-described manufacturing method for the coil component, it is preferable that the second seed layer not covered with the wiring layer be removed, and the first seed layer covered with neither the wiring layer nor the second seed layer be partially removed such that the first seed layer spaced from the first seed layer covered with both the wiring layer and the second seed layer becomes the close contact layer. According to this configuration, it is possible to easily form the close contact layer by partially removing the first seed layer.

A manufacturing method for a coil component according to an aspect of the present disclosure is a manufacturing method for a coil component including a multilayer body in which a plurality of resin insulation layers is laminated and a coil conductor layer formed in a spiral shape and disposed on one main surface of the resin insulation layer. The manufacturing method is also a manufacturing method for a coil component including a plurality of resin insulation layers, and a multilayer body in which a coil conductor layer formed in a spiral shape and a close contact layer are formed on one main surface of the resin insulation layer. Each of the methods includes forming a seed layer on an upper surface of a first resin insulation layer; forming a resist layer on an upper surface of the seed layer; forming a cavity in the resist layer; forming a wiring layer on the upper surface of the seed layer inside the cavity; removing the resist layer; removing, by etching, the whole part of the seed layer other than the seed layer on which the wiring layer is laminated; forming, on the upper surface of the first resin insulation layer, a close contact layer made of a metal having desired adhesion to the first resin insulation layer; and forming a second resin insulation layer covering the upper surface of the first resin insulation layer, the coil conductor layer, and the close contact layer.

According to this configuration, it is possible to easily form the coil component capable of suppressing the decrease in adhesion strength between the plurality of laminated resin insulation layers.

In the above-described manufacturing method for the coil component, it is preferable that the close contact layer include one plane or a plurality of small pieces being spaced from each other in a central portion of the spiral-shaped coil conductor layer, and that the manufacturing method further include forming, by laser processing, a through-hole passing through the multilayer body in a lamination direction in the central portion of the spiral-shaped coil conductor layer, and causing the through-hole to be filled with a magnetic material. According to this configuration, a laser beam is scattered by the close contact layer, and the inner diameter of the through-hole formed by the laser beam is increased. With this, since the volume of the magnetic material filling the through-hole increases, it is possible to improve the inductance.

Other features, elements, characteristics and advantages of the present disclosure will become more apparent from the following detailed description of preferred embodiments of the present disclosure with reference to the attached drawings.

DETAILED DESCRIPTION

Hereinafter, each of the embodiments will be described. It is noted that, in the accompanying drawings, constituent elements may be enlarged to facilitate understanding of the description. Dimensional ratios of the constituent elements may be different from the actual ones, or may be different from dimensional ratios in other drawings. In cross-sectional views, plan views, and the like, hatching is provided for facilitating the understanding of the description; however, hatching may be omitted in some of the constituent elements.

First Embodiment

Hereinafter, a first embodiment will be described.

Figure 1:
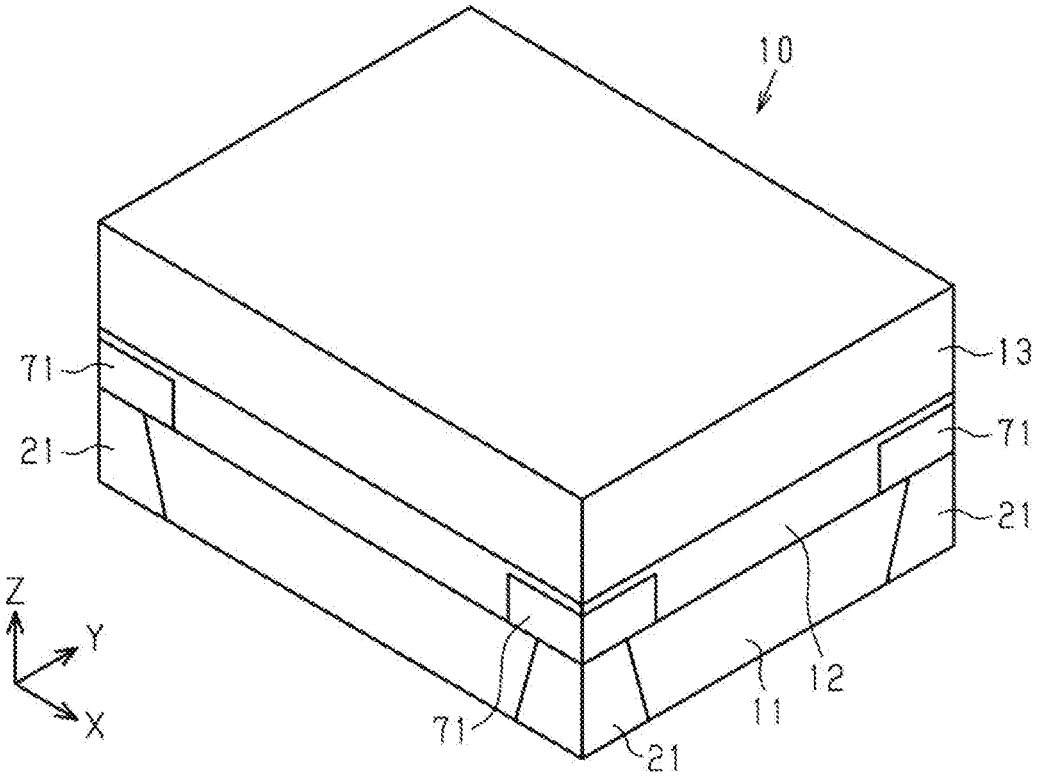
FIG. 1 is a schematic perspective view illustrating an external appearance of a coil component according to a first embodiment.

As illustrated in FIG. 1, a coil component 10 is formed in a substantially rectangular parallelepiped shape. The coil component 10 includes a multilayer body 12 in which a plurality of resin insulation layers 31 to 35 is laminated, spiral-shaped coil conductor layers 41 to 44 disposed on main surfaces of the plurality of resin insulation layers 31 to 34, close contact layers 51 to 54 disposed at interfaces between the respective plurality of resin insulation layers 31 to 35 and not connected to any of the coil conductor layers 41 to 44, a first magnetic substrate 11 and a second magnetic substrate 13 sandwiching the multilayer body 12 therebetween, and outer terminals 21. In the following description, a lamination direction of the coil component 10 is defined as a Z-axis direction; in addition, when viewed in a plan view from the Z-axis direction, a direction in which a long side extends is defined as an X-axis direction, and a direction in which a short side extends is defined as a Y-axis direction. Viewing from the Z-axis direction is also referred to as viewing in a plan view.

The first magnetic substrate 11 has a substantially rectangular parallelepiped shape. In the first magnetic substrate 11, the outer terminals 21 are formed on each of the corners in a plan view. A material of the first magnetic substrate 11 is, for example, a resin material containing magnetic powder. The magnetic powder is, for example, a metal magnetic material such as iron (Fe), silicon (Si), or chromium (Cr), and the resin material is, for example, a resin material such as epoxy. As a material of the first magnetic substrate 11, two or three kinds of magnetic powder different from each other in particle size distribution may be mixed. As a material of the first magnetic substrate 11, for example, a paste formed of sintered ferrite ceramic, ferrite calcination powder and a binder, a green sheet of a ferrite material, or the like can be used.

The outer terminal 21 is exposed at a lower surface of the first magnetic substrate 11, and is connected to a mounting substrate on which the coil component 10 is mounted, by solder or the like. The outer terminal 21 may be extended onto the lower surface of the first magnetic substrate 11.

Figure 2:
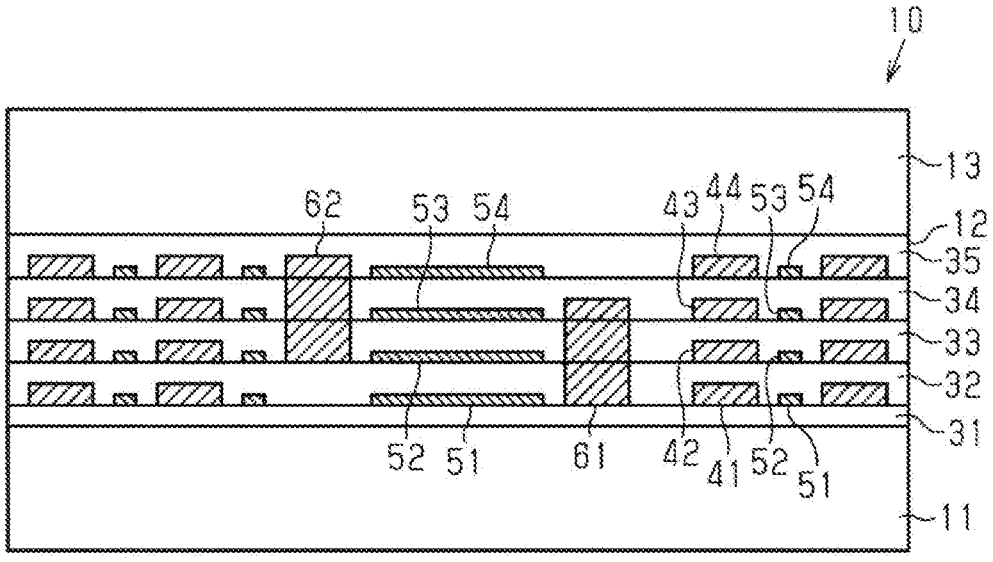
FIG. 2 is a schematic cross-sectional view illustrating a coil component according to the first embodiment.

As illustrated in FIG. 2, the multilayer body 12 has a structure in which the plurality of (five in the present embodiment) resin insulation layers 31 to 35 is laminated on the first magnetic substrate 11.

The plurality of coil conductor layers 41 to 44 is connected to each other by vias 61 and 62 passing through the resin insulation layers 32 to 34. Further, the plurality of coil conductor layers 41 to 44 is connected to the outer terminals 21 via connecting members 71 as illustrated in FIG. 1. In this embodiment, the coil component 10 is, for example, a common mode choke coil including two coils, and an end portion of each of the coils is connected to the outer terminal 21.

As a specific connection configuration, for example, one of the coils has a structure in which the outer terminal 21, the connecting member 71, an outer peripheral end of the coil conductor layer 41, an inner peripheral end of the coil conductor layer 41, the via 61, an inner peripheral end of the coil conductor layer 43, an outer peripheral end of the coil conductor layer 43, the connecting member 71, and the outer terminal 21 are connected in sequence in that order. At this time, the other one of the coils has a structure in which the outer terminal 21, the connecting member 71, an outer peripheral end of the coil conductor layer 42, an inner peripheral end of the coil conductor layer 42, the via 62, an inner peripheral end of the coil conductor layer 44, an outer peripheral end of the coil conductor layer 44, the connecting member 71, and the outer terminal 21 are connected in sequence in that order. However, the connection configuration of the coils is not limited to the above; for example, the connection configuration may be such that the coil conductor layer 41 and the coil conductor layer 44 are connected by the via 61, and the coil conductor layer 42 and the coil conductor layer 43 are connected by the via 62. Similarly, the connection configuration may be such that the coil conductor layer 41 and the coil conductor layer 42 are connected by the via 61, and the coil conductor layer 43 and the coil conductor layer 44 are connected by the via 62.

A second magnetic substrate 13 is disposed on an upper surface of the multilayer body 12. The second magnetic substrate 13 has a substantially rectangular parallelepiped shape. A material of the second magnetic substrate 13 is, for example, a resin material containing magnetic powder. The magnetic powder is, for example, a metal magnetic material such as Fe, Si, Cr or the like, and the resin material is, for example, a resin material such as epoxy. As a material of the second magnetic substrate 13, two or three kinds of magnetic powder different from each other in particle size distribution may be mixed. As a material of the second magnetic substrate 13, for example, a paste formed of sintered ferrite ceramic, ferrite calcination powder and a binder, a green sheet of a ferrite material, or the like can be used.

An internal configuration of the multilayer body 12 will be described in detail below.

As illustrated in FIG. 2, the resin insulation layer 31 is so formed as to cover an upper surface of the first magnetic substrate 11. The coil conductor layer 41 and the close contact layer 51 are disposed on one main surface (upper surface) of the identical resin insulation layer 31. According to this configuration, it is possible to suppress a decrease in adhesion strength at an interface between the resin insulation layers 31 and 32, and suppress the interfacial peeling more effectively, at an interface between the resin insulation layers 31 and 32 in which the adhesion strength is likely to decrease due to the arrangement of the coil conductor layer 41.

The resin insulation layer 32 is so formed as to cover the upper surface of the resin insulation layer 31, the coil conductor layer 41, and the close contact layer 51. In this manner, the close contact layer 51 is disposed at the interface between the resin insulation layers 31 and 32. The thickness of the close contact layer 51 is formed to be thinner than the thickness of the coil conductor layer 41. It is preferable for the thickness of the coil conductor layer 41 to be about 1 μm to about 100 μm, and particularly preferable to be about 5 μm to about 20 μm, for example, about 15 μm. It is more preferable for the thickness of the close contact layer 51 to be equal to or less than about 0.1 μm, because it is possible to reduce influence on the flatness of the resin insulation layer 32.

Figure 3:
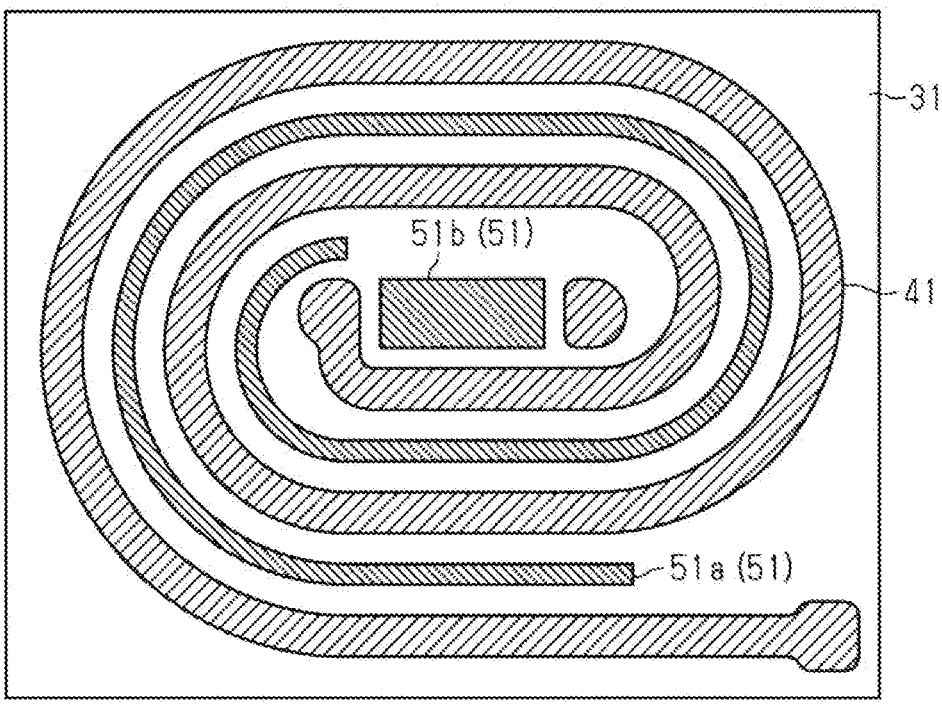
FIG. 3 is a schematic plan view illustrating a coil conductor and a close contact layer according to the first embodiment.

As illustrated in FIG. 3, the coil conductor layer 41 is formed in a flat spiral shape on one main surface (upper surface) of the resin insulation layer 31. The close contact layer 51 is formed to be spaced from the coil conductor layer 41 and is not electrically connected to the coil conductor layer 41. In particular, the close contact layer 51 is not electrically connected to any of the coil conductor layers 41 to 44. The close contact layer 51 of the present embodiment includes a linear portion 51*a* arranged between winding sections of the flat spiral-shaped coil conductor layer 41, and one plane 51*b* in a central portion of the flat spiral-shaped coil conductor layer 41. The linear portion 51*a* is formed continuously along the flat spiral-shaped coil conductor layer 41 and has a flat spiral shape. The plane 51*b* is formed in a substantially rectangular plate shape, and has a width larger than that of the coil conductor layer 41 and that of the linear portion 51*a*. Note that the shape of the plane 51*b* is not particularly limited, and may be a circular plate shape, an elliptical plate shape, a square plate shape, a polygonal plate shape other than a rectangular shape, or the like.

As illustrated in FIG. 2, the coil conductor layers 42 to 44 and the close contact layers 52 to 54 are disposed on one main surface (upper surface) of each of the corresponding identical resin insulation layers 32 to 34. The uppermost resin insulation layer 35 is so formed as to cover one main surface (upper surface) of the resin insulation layer 34 as a lower layer, the coil conductor layer 44, and the close contact layer 54. In this manner, the close contact layers 52 to 54 are respectively disposed at the interfaces of the corresponding resin insulation layers 32 to 35.

The coil conductor layers 42 to 44 illustrated in FIG. 2 are formed in a flat spiral shape (not illustrated) like the coil conductor layer 41. Further, although not illustrated, the close contact layers 52 to 54 are formed in the same manner as the close contact layer 51, and are not electrically connected to any of the coil conductor layers 41 to 44.

As a material of the resin insulation layers 31 to 35, for example, a resin such as polyimide, acryl, phenol, epoxy, or the like can be used. The coil conductor layers 41 to 44 are made of a conductive metal such as copper (Cu), silver (Ag) or gold (Au), and an alloy containing these metals. The close contact layers 51 to 54 contain a metal having desired adhesion to the resin insulation layers 31 to 35, such as titanium (Ti) or Cr; to be specific, they are a single metal layer of Ti or Cr, an alloy layer containing Ti and Cr (for example, a titanium nitride (TiN) layer), or the like. It is preferable that the close contact layers 51 to 54 contain a metal having good adhesion to the resin insulation layers 31 to 35 as compared with the coil conductor layers 41 to 44. In the present embodiment, as is indicated by an example given below, the coil conductor layers 41 to 44 and the close contact layers 51 to 54 are made of different metals from each other.

An example of the coil conductor layer 41 and the close contact layer 51 will be described.

Figure 4:
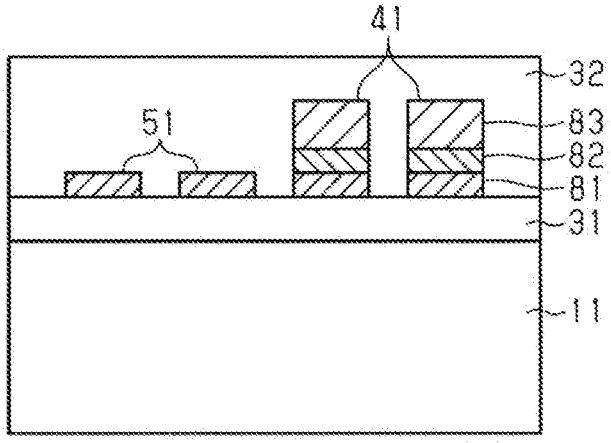
FIG. 4 is a schematic cross-sectional view illustrating an example of a configuration of a coil conductor and a close contact layer.

As illustrated in FIG. 4, the coil conductor layer 41 and the close contact layer 51 are formed on an upper surface 31*a* of the resin insulation layer 31. The coil conductor layer 41 is formed of three metal layers 81, 82, and 83. The first metal layer 81 is made of, for example, Ti, the second metal layer 82 is made of, for example, a thin film of Cu formed by a method to be explained later, and the third metal layer 83 is made of, for example, a thin film of Cu formed by a method to be explained later.

The close contact layer 51 is formed of a single metal layer, and is made of, for example, Ti. This close contact layer 51 can be formed, for example, along with the first metal layer 81 of the coil conductor layer 41 in one process, in other words, can be formed at the same time. Note that the close contact layer 51 and the first metal layer 81 of the coil conductor layer 41 may be formed in separate processes.

Similarly to the coil conductor layer 41, the coil conductor layers 42 to 44 are each formed of three layers including the metal layers 81 to 83. Similarly to the close contact layer 51, the close contact layers 52 to 54 are each formed of a single metal layer, and made of Ti, for example. Each of the close contact layers 52 to 54 is formed along with the first metal layer 81 forming each of the coil conductor layers 42 to 44 in one process. It is also possible to form each of the close contact layers 52 to 54 and the first metal layer 81 forming each of the coil conductor layers 42 to 44 by separate processes.

The case in which the coil conductor layers 41 to 44 and the close contact layers 51 to 54 are made of different metals as described above, is not limited to only a case in which the coil conductor layers and close contact layers are completely different metal layers from each other. As described above, even if the coil conductor layers 41 to 44 include the metal layer 81 of Ti, which is the same metal contained in the close contact layers 51 to 54, it is stated that the coil conductor layers 41 to 44 and the close contact layers 51 to 54 are made of different metals as long as the coil conductor layers 41 to 44 include the metal layers 82 and 83 of Cu, which is a different metal from the metal contained in the close contact layers.

Manufacturing Method for Coil Component

A method for forming the coil component 10 will be described while focusing on a method for forming two resin insulation layers 31 and 32 included in the multilayer body 12, and the coil conductor layer 41 and the close contact layer 51 on the main surface of one resin insulation layer 31. For convenience in explanation, a portion to finally become a constituent element of the coil component 10 may be assigned a reference sign of the final constituent element and explained.

Figure 5A:
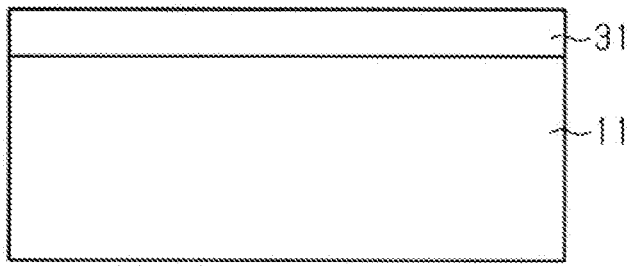
FIGS. 5A to 5C are schematic cross-sectional views illustrating a manufacturing process of a coil conductor and a close contact layer.

As illustrated in FIG. 5A, the resin insulation layer 31 is formed on the first magnetic substrate 11. As a material of the resin insulation layer 31, a resin such as polyimide can be used. The resin insulation layer 31 can be formed by, for example, spin coating, printing, or attaching a dry film.

Figure 5B:
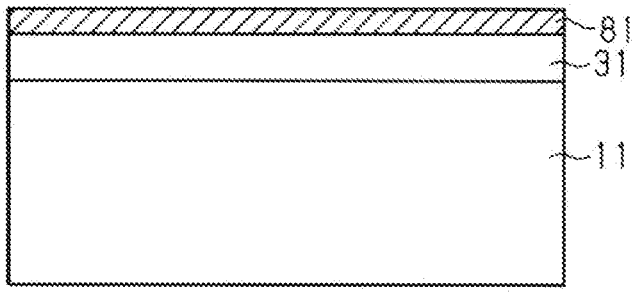

As illustrated in FIG. 5B, the first seed layer 81 is formed on the resin insulation layer 31. As a material of the first seed layer 81, used is a conductive material mainly containing a metal such as Ti or Cr having desired adhesion to the resin used for the resin insulation layer 31, an alloy of these metals, or the like. The first seed layer 81 may be formed by, for example, dry plating such as sputtering or vapor deposition, electroless plating, or metal foil attachment. The thickness of the first seed layer 81 may be, for example, about 0.1 μm.

Figure 5C:
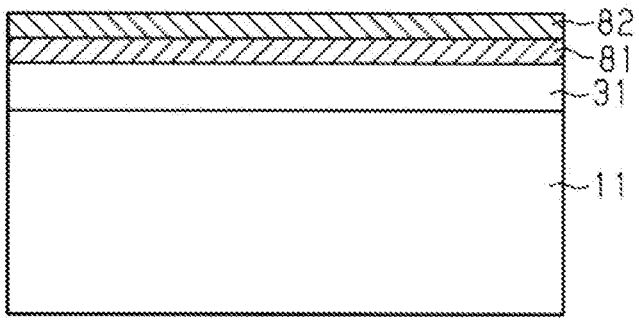

As illustrated in FIG. 5C, the second seed layer 82 is formed on the first seed layer 81. As a material of the second seed layer 82, a conductive material mainly containing a metal such as Cu or Ag with low electric resistance, an alloy of these metals, or the like can be used. The second seed layer 82 may be formed by, for example, dry plating such as sputtering or vapor deposition, electroless plating, or metal foil attachment. The thickness of the second seed layer 82 may be, for example, about 0.1 μm.

Figure 6A:
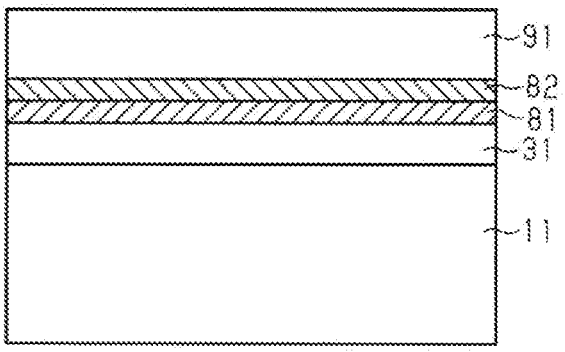
FIGS. 6A to 6C are schematic cross-sectional views illustrating a manufacturing process of a coil conductor and a close contact layer.

As illustrated in FIG. 6A, a resist layer 91 is formed on the second seed layer 82. As the resist layer 91, for example, a photosensitive resin can be used. The resist layer 91 may be formed by, for example, spin coating, printing, or attaching a dry film.

Figure 6B:
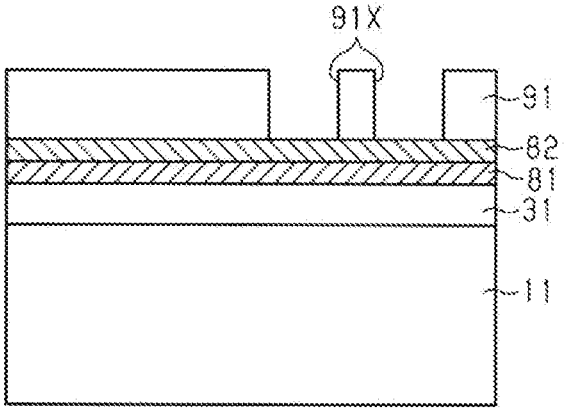

As illustrated in FIG. 6B, a cavity 91X is formed (patterned) in the resist layer 91. The cavity 91X is so formed as to expose a portion of the second seed layer 82 to become the coil conductor layer 41 (see FIG. 4). The cavity 91X may be formed as follows: a photosensitive resin is exposed by photolithography using a mask, for example, and then developing and cleaning are performed.

Figure 6C:
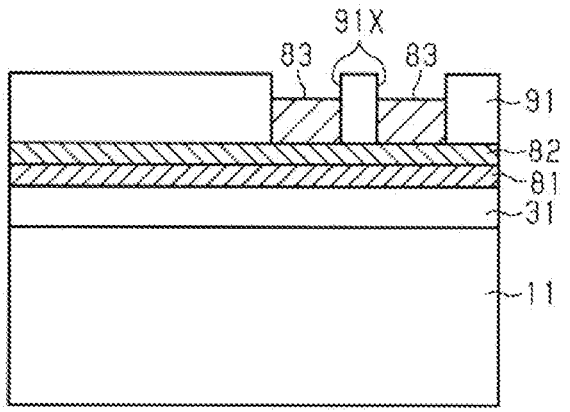

As illustrated in FIG. 6C, the wiring layer 83 is formed inside the cavity 91X of the resist layer 91. As a material of the wiring layer 83, a conductive material mainly containing a metal such as Cu or Ag with low electric resistance, an alloy of these metals, or the like may be used. For example, the wiring layer 83 is formed on the upper surface of the second seed layer 82 inside the cavity 91X of the resist layer 91 by an electrolytic plating method in which the first seed layer 81 and the second seed layer 82 are used as a plating power supply layer. The thickness of the wiring layer 83 may be, for example, about 10 μm.

Figure 7A:
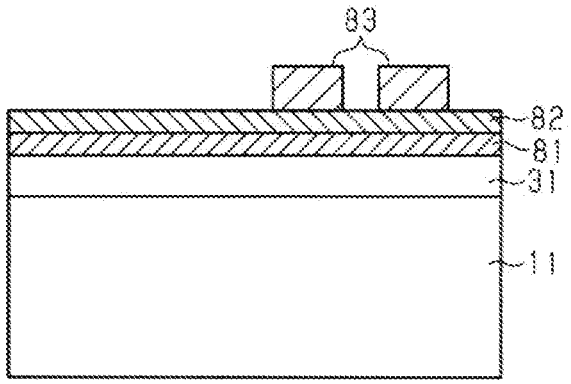
FIGS. 7A to 7C are schematic cross-sectional views illustrating a manufacturing process of a coil conductor and a close contact layer.

As illustrated in FIG. 7A, the resist layer 91 (see FIG. 6C) is removed. For example, the resist layer 91 is removed by being dipped in a stripping solution.

Figure 7B:
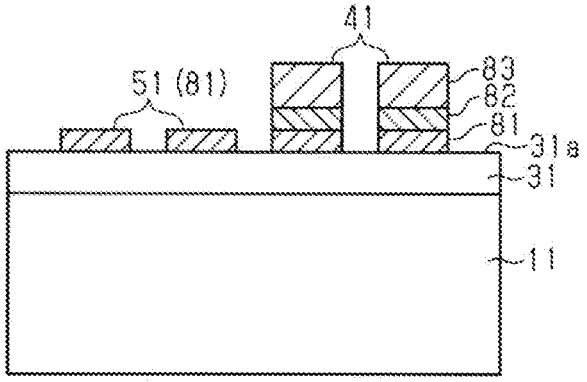

As illustrated in FIG. 7B, the exposed second seed layer 82 and part of the first seed layer 81 are removed by wet etching using the wiring layer 83 as a mask. Part of the first seed layer 81 is removed in such a manner that a portion of the first seed layer 81 other than the first seed layer 81 covered with the wiring layer 83 and the second seed layer 82 partially remains by weakening the etching with respect to the first seed layer 81. It is preferable that the remaining first seed layer 81 be electrically separated from the first seed layer 81 covered with the wiring layer 83 and the second seed layer 82. Through this process, the coil conductor layer 41 made of the first seed layer 81, the second seed layer 82 and the wiring layer 83 is formed, and the close contact layer 51 is also formed by the remaining first seed layer 81.

Figure 7C:
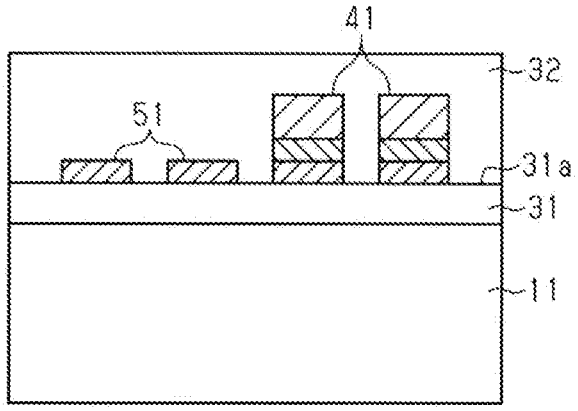

As illustrated in FIG. 7C, the resin insulation layer 32 that covers the upper surface 31*a* of the resin insulation layer 31 exposed from the close contact layer 51 and the coil conductor layer 41, the close contact layer 51, and the coil conductor layer 41 is formed. The resin insulation layer 32 may be formed by, for example, spin coating, printing, attaching a dry film, or the like.

Subsequently, the same process is repeated to form the multilayer body 12. Thereafter, by attaching the second magnetic substrate 13 onto the upper surface of the multilayer body 12, the coil component 10 is completed.

Modification of Manufacturing Method

It is also possible to form the first metal layer 81 of the coil conductor layer 41 and the close contact layer 51 illustrated in FIG. 4 in different processes.

The processes illustrated in FIG. 5A to FIG. 8A are carried out so that the first seed layer 81, the second seed layer 82 and the wiring layer 83 are formed, and the resist layer 91 is removed.

Figure 8A:
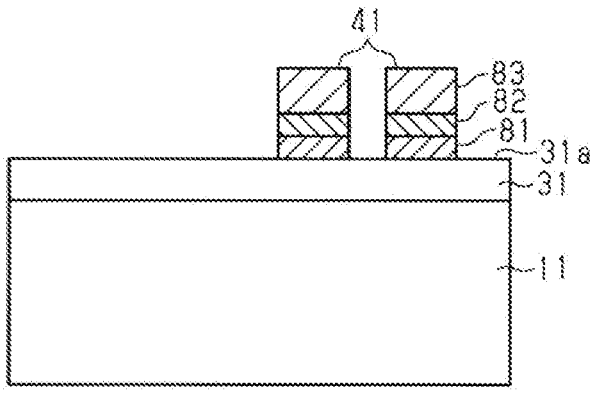
FIGS. 8A to 8C are schematic cross-sectional views illustrating a modification of a manufacturing process of a coil conductor and a close contact layer.

As illustrated in FIG. 8A, the exposed second seed layer 82 and the first seed layer 81 are removed by wet etching using the wiring layer 83 as a mask.

Figure 8B:
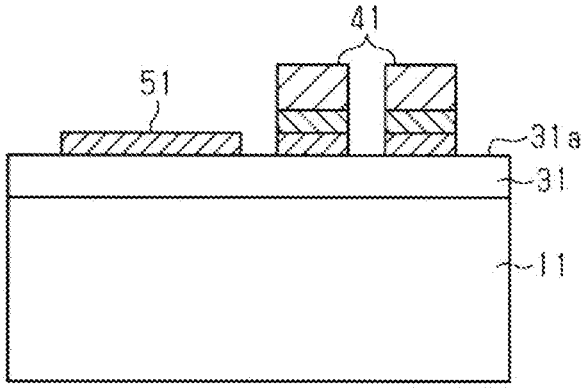

As illustrated in FIG. 8B, the close contact layer 51 is formed on the resin insulation layer 31. As a material of the close contact layer 51, used is a conductive material mainly containing a metal such as Ti or Cr having desired adhesion to the resin used for the resin insulation layer 31 or the like, an alloy of these metals, or the like. The close contact layer 51 may be formed by, for example, dry plating using a metal mask, attachment of a patterned metal foil, photolithography, or the like.

Figure 8C:
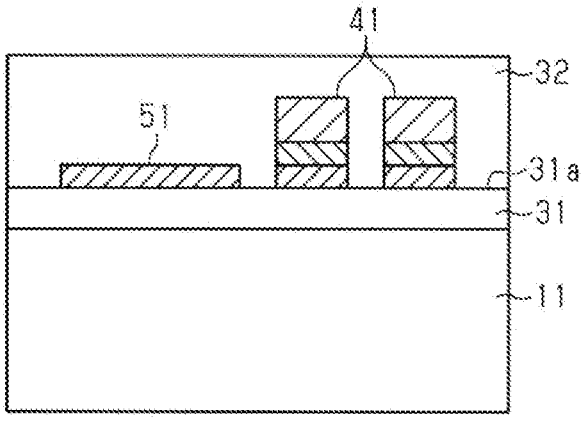

As illustrated in FIG. 8C, the resin insulation layer 32 that covers the upper surface 31*a* of the resin insulation layer 31 exposed from the close contact layer 51 and the coil conductor layer 41, the close contact layer 51, and the coil conductor layer 41 is formed. The resin insulation layer 32 may be formed by, for example, spin coating, printing, attaching a dry film, or the like.

Action

The coil component 10 includes the multilayer body 12 in which the plurality of resin insulation layers 31 to 35 is laminated, the flat spiral-shaped coil conductor layers 41 to 44 disposed on the main surfaces of the resin insulation layers 31 to 34, and the close contact layers 51 to 54 disposed at interfaces between the respective resin insulation layers 31 to 35 and not connected to the coil conductor layers 41 to 44, where the close contact layers 51 to 54 contain a metal having desired adhesion to the resin insulation layers 31 to 35.

With these close contact layers 51 to 54, it is possible to suppress a decrease in adhesion strength of the interfaces between the respective resin insulation layers 31 to 35 in the laminated resin insulation layers 31 to 35, whereby the interfacial peeling due to a thermal load during the manufacturing process, or after the mounting, is unlikely to occur. Because of this, deterioration in electric characteristics, an operation failure, or the like due to the decrease in the insulation resistance value can be suppressed.

In addition, with the close contact layers 51 to 54, since the interfacial peeling of the resin insulation layers 31 to 35 can be suppressed, it is possible to suppress an appearance defect of the coil component 10. Since the close contact layers 51 to 54 can be formed by only weakening the etching with respect to the first seed layer 81, a process for obtaining the anchor effect by irregularities or the like, a chemical treatment, and the like are unnecessary, so that the coil component 10 can be easily formed and an increase in cost required for the processing can be suppressed.

As illustrated in FIGS. 6A to 6C, in the processes of forming the coil conductor layers 41 to 44 and the close contact layers 51 to 54, the resist layer 91 having the cavity 91X is used. In the formation of the resist layer 91, a photosensitive resin is used, and exposing, developing and cleaning are performed to form the resist layer 91. For the exposure of the photosensitive resin, light of short wave length such as ultraviolet light is used, for example. For the first seed layer 81 used for forming the coil conductor layers 41 to 44 and the close contact layers 51 to 54, a metal such as Ti or Cr is used, for example, and these metals reflect part of the light of short wave length used for the exposure. In the coil component 10, since part of the first seed layer 81 remains as each of the close contact layers 51 to 54, it is possible to reduce the influence of the light of short wave length on the resin insulation layer located as a lower layer in the subsequent exposure process.

As described above, according to the present embodiment, the following effects can be obtained.

1-1. The coil component 10 includes the multilayer body 12 in which the plurality of resin insulation layers 31 to 35 is laminated, the flat spiral-shaped coil conductor layers 41 to 44 disposed on the main surfaces of the resin insulation layers 31 to 34, and the close contact layers 51 to 54 disposed at the interfaces between the respective resin insulation layers 31 to 35 and not connected to the coil conductor layers 41 to 44, where the close contact layers 51 to 54 contain a metal having desired adhesion to the resin insulation layers 31 to 35.

With these close contact layers 51 to 54, it is possible to suppress the decrease in adhesion strength of the interfaces between the respective resin insulation layers 31 to 35 in the laminated resin insulation layers 31 to 35, and the interfacial peeling due to a thermal load during the manufacturing process, or after the mounting, is unlikely to occur. Thus, the interfacial peeling can be suppressed.

1-2. With the close contact layers 51 to 54, since the interfacial peeling in the resin insulation layers 31 to 35 can be suppressed, it is possible to suppress an appearance defect of the coil component 10.

1-3. Since the close contact layers 51 to 54 can be formed by only weakening the etching with respect to the first seed layer 81, a process for obtaining the anchor effect by irregularities or the like, a chemical treatment, and the like are unnecessary, so that the coil component 10 can be easily formed and an increase in cost required for the processing can be suppressed.

1-4. It is preferable that the thickness of the close contact layers 51 to 54 be equal to or less than about 0.1 μm, thereby making it possible to suppress the influence thereof on the flatness of the resin insulation layers 31 to 35.

1-5. It is preferable that the first magnetic substrate 11 and the second magnetic substrate 13 sandwiching the multilayer body 12 be further included, and that, in the multilayer body 12, the resin insulation layers 31 to 35 be laminated in a direction from the first magnetic substrate 11 toward the second magnetic substrate 13. Due to a difference between a thermal expansion coefficient of the first and second magnetic substrates 11, 13 and a thermal expansion coefficient of the resin insulation layers 31 to 35, the adhesion strength is likely to decrease. To deal with this, by providing the close contact layers 51 to 54, the decrease in adhesion strength is suppressed, and the effect of suppressing the interfacial peeling is more effectively exhibited.

Modification of First Embodiment

In the coil component 10, although the close contact layers 51 to 54 include the flat spiral-shaped linear portion 51*a* continuously formed along the flat spiral-shaped coil conductor layers 41 to 44, the plate-shaped plane 51*b* formed in the central portion of the coil conductor layers 41 to 44, and the like, the shape of the close contact layers 51 to 54 is not limited thereto.

Figure 9:
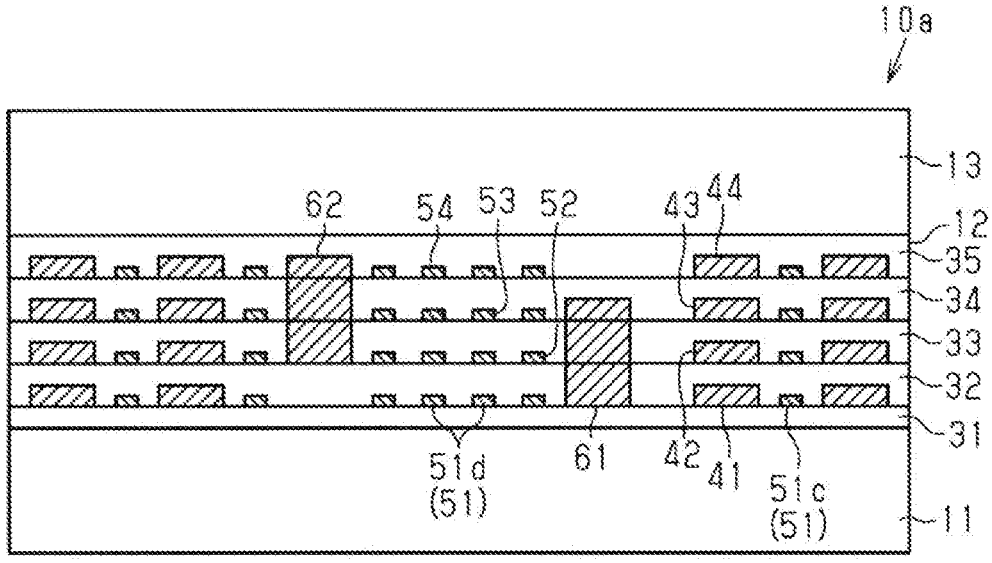
FIG. 9 is a schematic cross-sectional view illustrating a coil component according to a modification.
Figure 10:
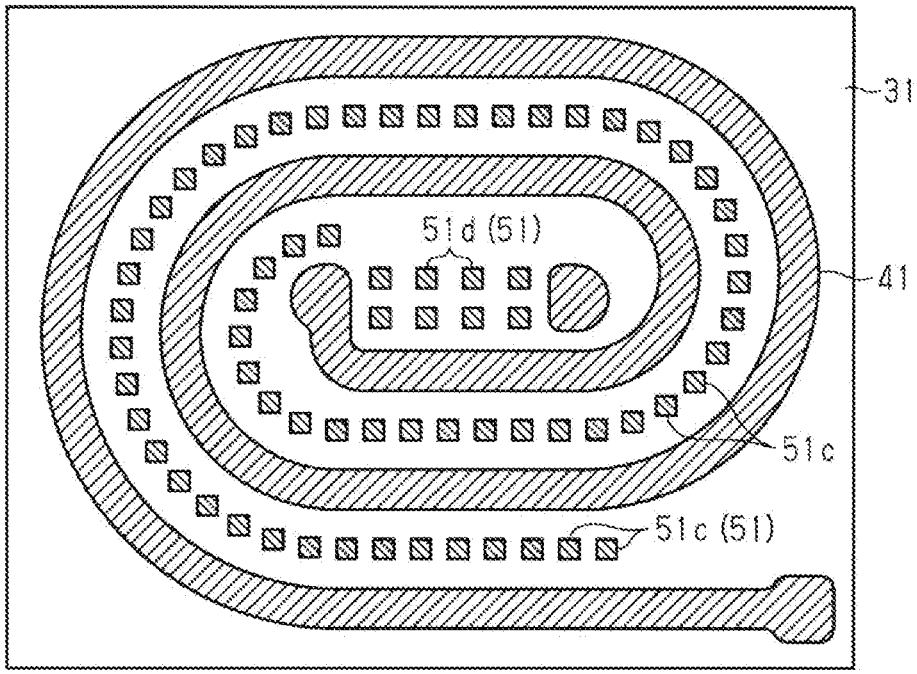
FIG. 10 is a schematic plan view illustrating a coil conductor and a close contact layer according to a modification.

As illustrated in FIGS. 9 and 10, in a coil component 10*a*, close contact layers 51 to 54 are formed of a plurality of small pieces 51*c* and a plurality of small pieces 51*d*. As illustrated in FIG. 10, the plurality of small pieces 51*c* is spaced from each other along a flat spiral-shaped coil conductor layer 41, and is disposed being spaced from the coil conductor layer 41. The plurality of small pieces 51*d* is spaced from each other and is disposed being spaced from the flat spiral-shaped coil conductor layer 41 in a central portion of the coil conductor layer 41. The plurality of small pieces 51*c* and the plurality of small pieces 51*d* are formed in a substantially square shape, and both the line width and the line length thereof are smaller than the line width of the coil conductor layer 41. Also in the case where the close contact layer 51 is formed in this manner, the same effect as that of the above-described embodiment can be obtained. Note that, although the small pieces 51*c* and 51*d* are formed in a substantially square shape, the shape thereof is not limited thereto, and may be a rectangular shape, other polygonal shapes than a rectangular shape, a circular shape, an elliptical shape, a combination thereof, or the like.

Second Embodiment

Hereinafter, a coil component according to a second embodiment will be described.

In this embodiment, the same constituent elements as those in the above-described embodiment are denoted by the same reference signs, and some or all of the description thereof may be omitted.

Figure 11:
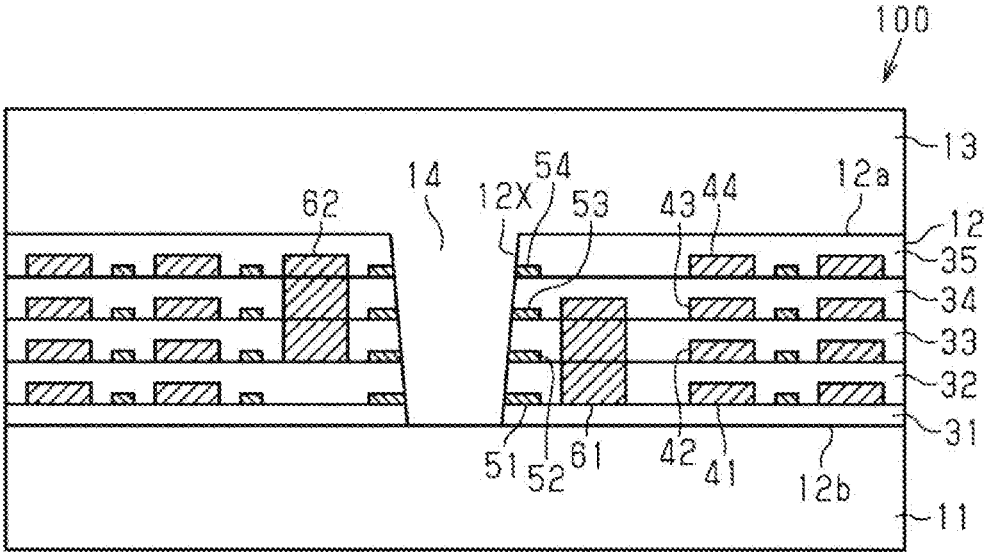
FIG. 11 is a schematic cross-sectional view illustrating a coil component according to a second embodiment.

As illustrated in FIG. 11, a coil component 100 includes a first magnetic substrate 11, a multilayer body 12 in which a plurality of resin insulation layers 31 to 35 is laminated, coil conductor layer 41 to 44 disposed on one main surface of each of the resin insulation layers 31 to 34, close contact layers 51 to 54 disposed at interfaces between the respective plurality of resin insulation layers 31 to 35, and a second magnetic substrate 13.

Figure 12:
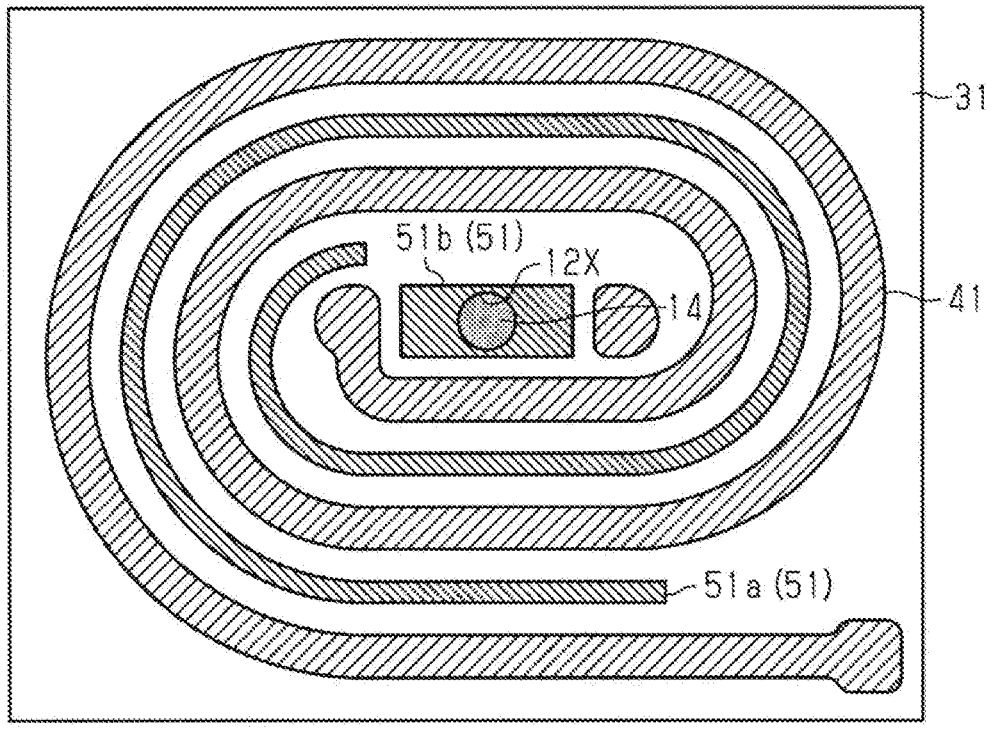
FIG. 12 is a schematic plan view illustrating a coil conductor and a close contact layer according to the second embodiment.

As illustrated in FIG. 12, the coil conductor layer 41 is formed in a flat spiral shape on one main surface (upper surface) of the resin insulation layer 31. The close contact layer 51 is formed to be spaced from the coil conductor layer 41 and is not electrically connected to the coil conductor layer 41. The close contact layer 51 of the present embodiment includes a linear portion 51*a* arranged between winding sections of the flat spiral-shaped coil conductor layer 41, and one plane 51*b* in a central portion of the flat spiral-shaped coil conductor layer 41. The linear portion 51*a* is formed continuously along the flat spiral-shaped coil conductor layer 41.

The coil conductor layers 42 to 44 illustrated in FIG. 11 are formed in a flat spiral shape (not illustrated) like the coil conductor layer 41. Although not illustrated, the close contact layers 52 to 54 are formed in the same manner as the close contact layer 51.

As illustrated in FIG. 11, a through-hole 12X passing through between an upper surface and a lower surface of the multilayer body 12 is formed in the multilayer body 12. In the through-hole 12X, an internal magnetic path 14 filled with a magnetic material is formed. The internal magnetic path 14 is integrally formed with the second magnetic substrate 13 on the multilayer body 12. The second magnetic substrate 13 is magnetically coupled to the first magnetic substrate 11 through the internal magnetic path 14.

The internal magnetic path 14 and the second magnetic substrate 13 are, for example, made of a resin material containing magnetic powder. The magnetic powder is, for example, a metal magnetic material such as Fe, Si, Cr or the like, and the resin material is, for example, a resin material such as epoxy. As a material of the internal magnetic path 14 and the second magnetic substrate 13, two or three kinds of magnetic powder different from each other in particle size distribution may be mixed. Further, as a material of the internal magnetic path 14 and the second magnetic substrate 13, for example, a paste formed of sintered ferrite ceramic, ferrite calcination powder and a binder, a green sheet of a ferrite material, or the like can be used. Note that the second magnetic substrate 13 and the internal magnetic path 14 need not be integrally formed; for example, sintered ferrite ceramic may be used for the second magnetic substrate 13, and a resin material containing magnetic powder may also be used for the internal magnetic path 14.

The internal magnetic path 14 has a higher permeability than the resin insulation layers 31 to 35, and increases the density of magnetic flux generated by a current flowing through the coil conductor layers 41 to 44. With this configuration, it is possible to significantly improve the inductance of the coil component 100.

Figure 13:
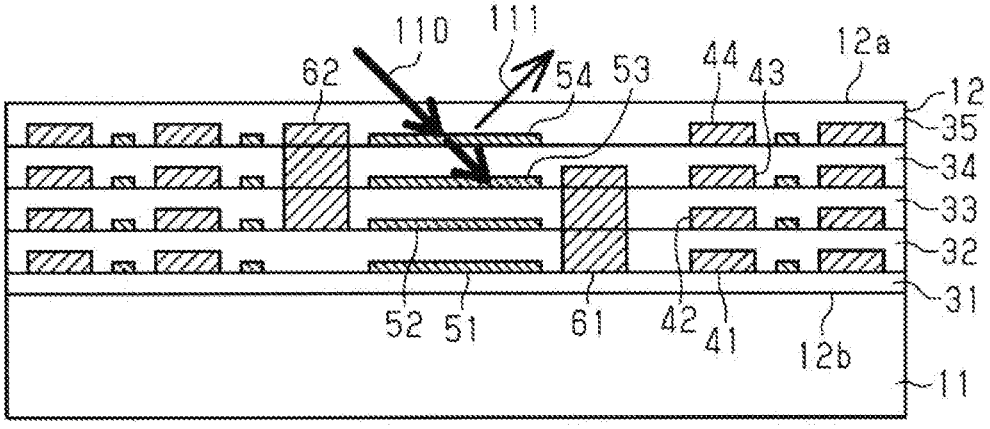
FIG. 13 is a schematic cross-sectional view illustrating a process of forming a cavity of a multilayer body in FIG. 11.

The through-hole 12X of the multilayer body 12 illustrated in FIG. 11 is formed by, for example, laser processing. As illustrated in FIG. 13, for example, a laser beam 110 is radiated toward an upper surface 12*a* of the multilayer body 12. For example, a laser machine such as a $CO_2$ laser or a UV-YAG laser can be used for the radiation of the laser beam 110. In the multilayer body 12, the laser beam 110 is radiated toward a central region of the flat spiral-shaped coil conductor layer 41. The close contact layer 51 is formed in a region to be irradiated with the laser beam 110. The close contact layer 51 scatters the radiated laser beam 110. In the multilayer body 12, a scattered laser beam 111 increases the inner diameter of the through-hole 12X. The influence of the laser beam 111 scattered in this manner is effectively exerted on a deep location of the through-hole 12X, that is, more effectively exerted on a side toward the resin insulation layer 31 as a lower layer. Accordingly, it is possible to form the through-hole 12X in which a difference between an opening diameter at the upper surface 12*a* of the multilayer body 12 and an opening diameter at a lower surface 12*b* of the multilayer body 12 is small.

Figure 14:
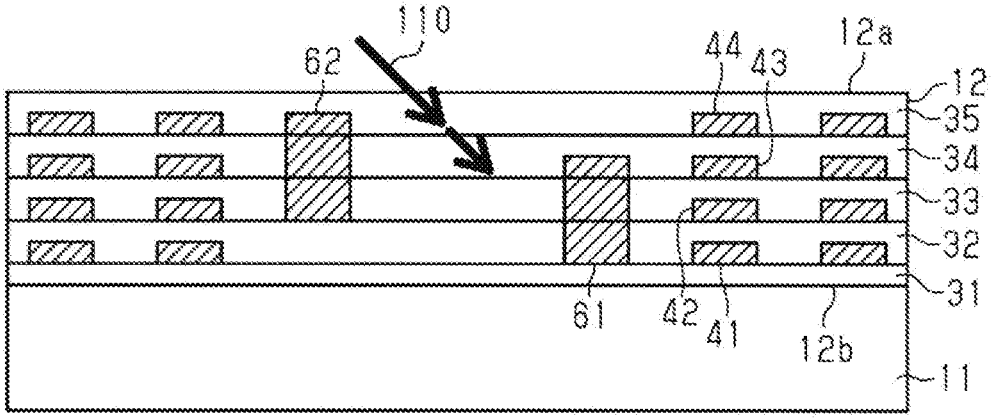
FIG. 14 is a schematic cross-sectional view illustrating a process of forming a cavity in a multilayer body according to a comparative example.
Figure 15:
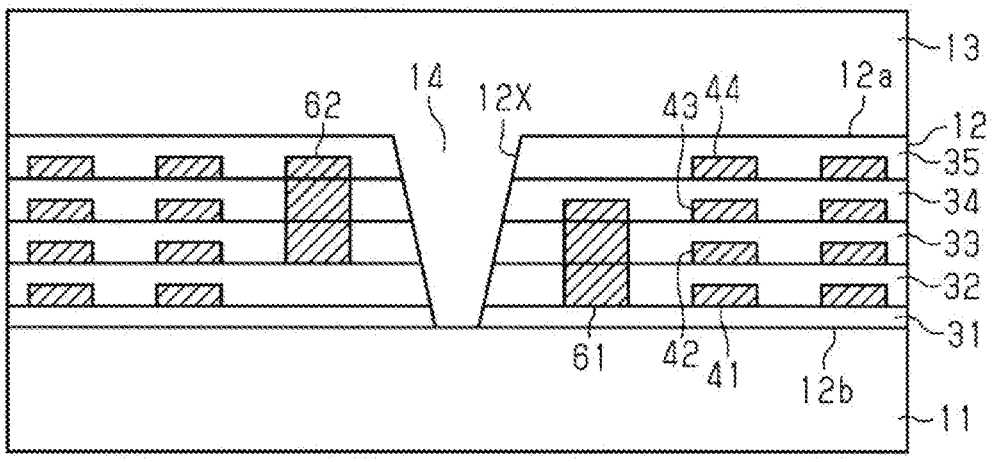
FIG. 15 is a schematic cross-sectional view illustrating a coil component according to a comparative example.

As illustrated in FIG. 14, in a case of a multilayer body 12 including no close contact layer as a comparative example, a laser beam 110 radiated from an upper surface 12*a* of the multilayer body 12 reaches a resin insulation layer 31 as a lower layer without being scattered. In general, a laser beam has a lower radiation intensity in a peripheral portion than in a central portion, and a difference in machinability occurs depending the radiation intensity. For this reason, as for the shape of a through-hole formed by the laser beam, for example, the diameter at the bottom side of the through-hole tends to be smaller than the diameter at the incidence side of the through-hole. Accordingly, as illustrated in FIG. 15, a through-hole 12X having a small diameter at a lower surface 12*b* of the multilayer body 12 is formed. In this case, in accordance with a cross-sectional area of an internal magnetic path 14 formed in the through-hole 12X (an area of the internal magnetic path 14 in a plane orthogonal to the lamination direction), the magnetic flux passing through the internal magnetic path 14 is reduced, and thus the improvement of the inductance is prevented.

On the other hand, in the coil component 100 of the present embodiment, the close contact layers 51 to 54 are each formed at a position to be irradiated with the laser beam 110, and these close contact layers 51 to 54 scatter the radiated laser beam 110, thereby making it possible to form the through-hole 12X having a large diameter at the lower surface 12*b* side of the multilayer body 12. Therefore, the cross-sectional area of the internal magnetic path 14 formed in the through-hole 12X is also increased, so that the inductance of the coil component 100 can be improved.

By the scattered laser beam 111, the inner diameter of the through-hole 12X is increased. Accordingly, since the volume of the internal magnetic path 14 filling the through-hole 12X increases and the amount of the magnetic material buried in the through-hole 12X increases, the magnetic flux interlinked with the coil conductor layers 41 to 44 increases, and thus the inductance is improved. With this, for example, in a case where the coil component 100 is a common mode choke coil, noise-cut characteristics are improved.

As discussed thus far, according to the present embodiment, in addition to the effects of the first embodiment described above, the following effects can be obtained.

2-1. In the coil component 100, the close contact layers 51 to 54 are each formed at a position to be irradiated with the laser beam 110, and these close contact layers 51 to 54 scatter the radiated laser beam 110, thereby making it possible to form the through-hole 12X having a large diameter at the lower surface 12*b* side of the multilayer body 12. Therefore, the cross-sectional area of the internal magnetic path 14 formed in the through-hole 12X is also increased, so that the inductance of the coil component 100 can be improved.

2-2. Since the volume of the internal magnetic path 14 filling the through-hole 12X increases and the amount of the magnetic material buried in the through-hole 12X increases, the magnetic flux interlinked with the coil conductor layers 41 to 44 increases, and thus the noise-cut characteristics are improved.

Modification of Second Embodiment

Figure 16:
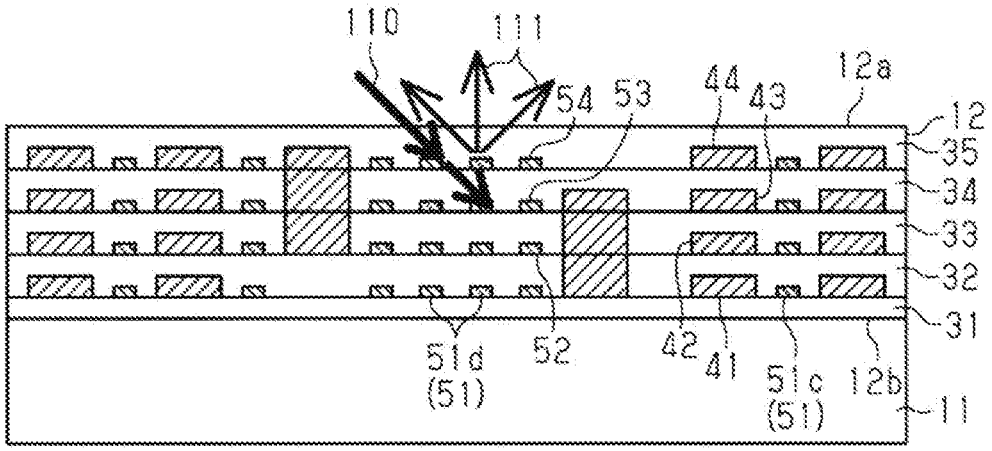
FIG. 16 is a schematic cross-sectional view illustrating processing of manufacture with respect to a multilayer body according to a modification of the second embodiment.
Figure 17:
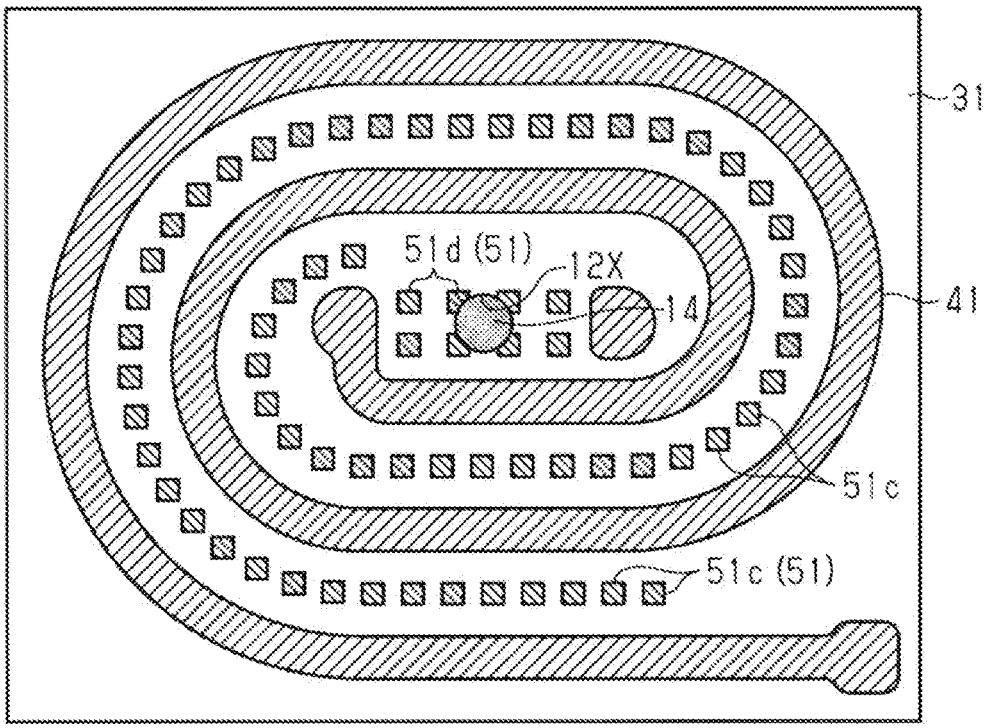
FIG. 17 is a schematic plan view illustrating a coil conductor layer and a close contact layer according to a modification of the second embodiment.

As illustrated in FIGS. 16 and 17, in a case where a close contact layer 51 including a plurality of small pieces 51*d* is formed, a laser beam 110 is scattered by the plurality of small pieces 51*d*, whereby a through-hole 12X having a larger diameter can be easily formed.

Other Modifications

The above-described embodiments may be carried out in the following modes.

In the above embodiments, although the coil components 10 and 100 each including two coils are provided, one, three, or more than three coils may be included in the coil component. For example, all the coil conductor layers 41 to 44 of the coil component 10 may be connected in series so as to constitute an inductor component including one coil. There is no limitation on the number of coil conductor layers, and it is sufficient that at least one contact surface between a resin insulation layer and a close contact layer is present. Although the coil conductor layer has a flat spiral shape, it may have a three-dimensional helical shape. The "flat spiral shape" refers to a swirly shape depicting a spire wound at least one turn on the identical plane, while the "three-dimensional helical shape" refers to a helical shape depicting a spire wound with a constant diameter along a central axis line. Further, the coil conductor layer may be formed in a shape in which a flat spiral shape and a three-dimensional helical shape are combined.

The coil conductor layers 41 to 44 and the close contact layers 51 to 54 need not be disposed on a main surface of each of the identical resin insulation layers 31 to 34. Specifically, the resin insulation layers 31 to 34 may be present in such a manner that only the coil conductor layers 41 to 44 or only the close contact layers 51 to 54 are disposed on each of the main surfaces thereof.

The above-described embodiments may variously combine their constituent elements. For example, with regard to the first embodiment, the close contact layer 51 illustrated in FIG. 3 may include either the linear portion 51*a* between the winding sections of the coil conductor layer 41 or the plane 51*b* in the central region of the coil conductor layer 41. Similarly, the close contact layer 51 illustrated in FIG. 10 may include either the small pieces 51*c* between the winding sections of the coil conductor layer 41 or the small pieces 51*d* in the central region of the coil conductor layer 41.

There are no limitations on the numbers, presence or absence, and the like of the constituent elements such as magnetic substrates, outer terminals, and connecting members in the coil component.

The above-described manufacturing method for the coil component is merely an example, and is not limited to the method of the embodiment. For example, although the coil conductor layers 41 to 44 are formed by a semi-additive process, they may be formed by a process such as a subtractive process, an additive process, or the like.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a multilayer body in which a plurality of resin insulation layers is laminated;

a coil conductor layer formed in a spiral shape and disposed on a main surface of one of the resin insulation layers; and at least one close contact layer disposed at an interface between two of the resin insulation layers and not connected to the coil conductor layer, the close contact layer containing a metal having desired adhesion to the resin insulation layer, wherein the close contact layer is formed continuously along the coil conductor layer, the close contact layer is entirely surrounded by the two of the resin insulation layers, and the close contact layer is not electrically connected to outside of the multilayer body.

2. The coil component according to claim 1, wherein the close contact layer is disposed on the main surface of the resin insulation layer.

3. The coil component according to claim 1, wherein a portion of the close contact layer is disposed in a central region of the spiral-shaped coil conductor layer when viewed in a stacking direction.

4. The coil component according to claim 1, wherein the close contact layer includes a plurality of pieces spaced from each other in the central region of the spiral-shaped coil conductor layer.

5. The coil component according to claim 1, wherein the at least one close contact layer includes a plurality of close contact layers spaced from each other along the coil conductor layer.

6. The coil component according to claim 1, wherein the multilayer body has a through-hole passing through the multilayer body in a lamination direction of the plurality of resin insulation layers in the central region of the spiral-shaped coil conductor layer, and includes an internal magnetic path filling the through-hole.

7. The coil component according to claim 1, wherein the coil conductor layer and the close contact layer are made of different materials from each other.

8. The coil component according to claim 7, wherein the coil conductor layer is formed of a seed layer containing chromium or titanium, and a wiring layer containing copper disposed on the seed layer, and the close contact layer is made of chromium or titanium.

9. The coil component according to claim 1, wherein a thickness of the coil conductor layer is 1 μm to 100 μm, and a thickness of the close contact layer is equal to or less than 0.1 μm.

10. The coil component according to claim 1, further comprising:

a first magnetic substrate and a second magnetic substrate including the multilayer body, wherein in the multilayer body, the resin insulation layers are laminated in a direction from the first magnetic substrate toward the second magnetic substrate.

11. The coil component according to claim 2, wherein a portion of the close contact layer is disposed in a central region of the spiral-shaped coil conductor layer when viewed in a stacking direction.

12. The coil component according to claim 2, wherein the close contact layer includes a plurality of pieces spaced from each other in the central region of the spiral-shaped coil conductor layer.

* * * * *